US010522953B2

(12) United States Patent
Miyazaki et al.

(10) Patent No.: US 10,522,953 B2
(45) Date of Patent: Dec. 31, 2019

(54) COAXIAL ELECTRICAL CONNECTOR AND MANUFACTURING METHOD THEREOF

(71) Applicant: Hirose Electric Co., Ltd., Shinagawa-ku, Tokyo (JP)

(72) Inventors: Atsuhiro Miyazaki, Tokyo (JP); Masahiro Tsuchida, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/181,683

(22) Filed: Nov. 6, 2018

(65) Prior Publication Data

US 2019/0074643 A1 Mar. 7, 2019

Related U.S. Application Data

(63) Continuation of application No. 15/821,357, filed on Nov. 22, 2017, now Pat. No. 10,158,200.

(30) Foreign Application Priority Data

Nov. 28, 2016 (JP) ..... 2016-230118

(51) Int. Cl.
*H01R 24/38* (2011.01)
*H01R 13/20* (2006.01)
(Continued)

(52) U.S. Cl.
CPC ..... *H01R 24/38* (2013.01); *H01R 12/716* (2013.01); *H01R 12/75* (2013.01); *H01R 13/03* (2013.01);
(Continued)

(58) Field of Classification Search
CPC ..... H01R 24/38; H01R 24/46; H01R 43/16; H01R 12/75
(Continued)

(56) References Cited

U.S. PATENT DOCUMENTS 6,474,995 B1 * 11/2002 Wu ..... H01R 24/50 439/63
6,902,408 B2 * 6/2005 Yamane ..... H01R 24/50 439/581
(Continued)

FOREIGN PATENT DOCUMENTS

JP 3103794 U 8/2004
JP 2010-272244 A 12/2010
(Continued)

*Primary Examiner* — Tulsidas C Patel
*Assistant Examiner* — Peter G Leigh
(74) *Attorney, Agent, or Firm* — Procopio, Cory, Hargreaves & Savitch LLP

(57) ABSTRACT

A coaxial electrical connector connected to a circuit board having a metal outer conductor having a tubular portion and a metal center conductor equipped with a contact portion extending in the axial direction of said tubular portion within the interior space of said tubular portion, and in which said center conductor is secured in place by the outer conductor, with a dielectric interposed therebetween, the center conductor has a radial portion with a plate-shaped configuration extending radially outward from the base portion side of the contact portion, and a connecting portion placed in contact with a circuit board is formed on the bottom face of said radial portion, wherein the radial portion has grain flow lines formed by a flow of metallographic structure oriented parallel to two major surfaces opposing each other in the axial direction, and the contact portion has grain flow lines oriented in the axial direction.

5 Claims, 5 Drawing Sheets

(51) Int. Cl.

| | |
|---|---|
| ***H01R 24/50*** | (2011.01) |
| ***H01R 12/71*** | (2011.01) |
| ***H01R 12/75*** | (2011.01) |
| ***H01R 13/03*** | (2006.01) |
| ***H01R 43/16*** | (2006.01) |
| *H01R 103/00* | (2006.01) |

(52) U.S. Cl.
CPC ..... *H01R 13/20* (2013.01); *H01R 24/50* (2013.01); *H01R 43/16* (2013.01); *H01R 2103/00* (2013.01)

(58) Field of Classification Search
USPC ..... 439/63
See application file for complete search history.

(56) References Cited

U.S. PATENT DOCUMENTS

| | | | | |
|---|---|---|---|---|
| 7,217,156 | B2 * | 5/2007 | Wang | H01R 4/184 439/579 |
| 7,334,327 | B1 * | 2/2008 | Chen | H01R 43/24 264/104 |
| 8,123,555 | B2 * | 2/2012 | Chen | H01R 43/24 439/578 |
| 8,262,398 | B2 * | 9/2012 | Chen | H01R 24/50 439/188 |
| 8,512,073 | B2 * | 8/2013 | Takano | H01R 24/50 439/578 |
| 8,542,079 | B2 * | 9/2013 | Sherrer | H01P 3/06 333/34 |
| 9,172,194 | B2 * | 10/2015 | Maruyama | H01R 24/38 |
| 9,276,364 | B2 * | 3/2016 | Mitsuno | H01R 33/205 |
| 9,509,106 | B2 * | 11/2016 | Nakamura | H01R 24/50 |
| 9,905,968 | B2 * | 2/2018 | Yanase | H01R 13/6315 |
| 2004/0137764 | A1 * | 7/2004 | Yamane | H01R 24/50 439/63 |
| 2010/0248503 | A1 * | 9/2010 | Kang | H01R 24/50 439/63 |

FOREIGN PATENT DOCUMENTS

| | | | |
|---|---|---|---|
| JP | 2010272244 | A | * 12/2010 |
| JP | 2014127398 | A | 7/2014 |

* cited by examiner (A)

(B)

(C)

(D)

COAXIAL ELECTRICAL CONNECTOR AND MANUFACTURING METHOD THEREOF

CROSS REFERENCE TO RELATED APPLICATIONS

This application is a continuation of U.S. patent application Ser. No. 15/821,357, filed on Nov. 22, 2017, which claims benefit under 35 U.S.C. § 119 and claims priority to Japanese Patent Application No. JP 2016-230118, filed on Nov. 28, 2016, titled "COAXIAL ELECTRICAL CONNECTOR AND MANUFACTURING METHOD THEREOF", the content of which is incorporated herein in its entirety by reference for all purposes.

BACKGROUND

Technical Field

The present invention relates to a coaxial electrical connector and a manufacturing method thereof.

Background Art

Coaxial electrical connectors, which have a cylindrical outer conductor and a center conductor equipped with a shaft-like contact portion provided along its axis, have both conductors secured in place using an insulator. With connectors recently becoming more compact and the above-mentioned center conductors becoming extremely small, such connectors, as well as their manufacturing method, require in-depth examination.

For instance, a proposal regarding such coaxial electrical connectors and their manufacturing method has been presented in Patent Document 1.

In Patent Document 1, which makes use of a plate-shaped blank with a thickness equal to or greater than the length of a shaft-like contact portion provided in a center conductor, the periphery of the location that is used as the contact portion is swaged in the through-thickness direction to thereby reduce its thickness, and the section remaining in the above-mentioned location is used as the contact portion. If the thickness of the plate-shaped blank of stock material is equal to the length of said contact portion, the blank is not subjected to any swaging or other processing, and if the thickness of the plate-shaped blank of stock material is greater than the length of the contact portion, the blank is swaged to the length of the contact portion.

Since the section of reduced thickness on the periphery of the contact portion extends and expands in a direction perpendicular thereto, that is, in a direction parallel to the major surfaces by the amount of swaging in the through-thickness direction, after the swaging process, it is subjected to punching to produce predetermined dimensions and shape, thereby obtaining a center conductor.

PRIOR ART DOCUMENTS

Patent Documents

[Patent Document 1]

Japanese Patent Application Publication No. 2014-127398.

SUMMARY

Problems to be Solved by the Invention

With coaxial electrical connectors becoming more compact, the strength of the center conductor in resisting external forces that act on said central conductor during mating with counterpart connectors tends to decrease. Therefore, even though central connectors are becoming more compact, it is desirable to ensure as much strength as possible at such dimensions.

In Patent Document 1, sheet metal is used for the plate-shaped blank and said plate-shaped blank is processed to fabricate a center conductor. In order to improve the strength of the sheet metal along with setting its thickness to a predetermined uniform value and making its major surfaces smooth and flat, the sheet metal is usually fabricated by rolling. Therefore, the flow of metallographic structure in the sheet metal (grain flow lines) extends in the direction of rolling and the strength of the sheet metal in the direction of grain flow is higher than in other directions. In the case of Patent Document 1, the stock material used to make the center conductor is sheet metal, and since the sheet metal is usually fabricated by rolling, in Patent Document 1, the grain flow lines of the plate-shaped blank obtained from the sheet metal are also oriented in the direction of rolling, i.e., in a direction parallel to the major surfaces, and its strength in this direction is higher than in other directions.

However, in Patent Document 1, the basic configuration of the center conductor is produced by swaging the plate-shaped blank by applying pressure in a direction perpendicular to its major surfaces in order to reduce its thickness. If the thickness of the stock metal blank is equal to the length of the contact portion, the location that is used as the contact portion is not swaged, and if its thickness is greater than the length of the contact portion, then it is swaged only by the amount of the difference. Although the perimeter of the contact portion is only swaged in the through-thickness direction and, therefore, the grain flow lines are parallel to plate thickness in the original state, the contact portion is either not subjected to swaging or any other processing, or alternatively, is swaged only by the above-mentioned difference in the through-thickness direction, i.e., in the longitudinal direction of the contact portion. Consequently, the direction of the grain flow lines in the contact portion is made perpendicular to the longitudinal direction (axial direction) of the contact portion. Therefore, the strength of the contact portion in its longitudinal direction decreases. At the least, no improvement is achieved in terms of strength.

It is an object of the present invention to take these circumstances into consideration and provide a coaxial electrical connector and a manufacturing method thereof wherein the strength of the contact portion, which extends such that its longitudinal direction corresponds to the axial direction of the center conductor, is improved even though the coaxial electrical connector is made more compact. It is an object of the invention to provide a coaxial electrical connector and a manufacturing method thereof, in which the strength of the contact portion of the center conductor is improved.

Means for Solving the Problems

According to the present invention, the above-described objects are achieved using a coaxial electrical connector and a manufacturing method for a coaxial electrical connector configured as described below.

<Coaxial Electrical Connector>

The inventive coaxial electrical connector, which is a coaxial electrical connector connected to a circuit board, has a metal outer conductor with a tubular portion and a metal center conductor provided with a contact portion extending in the axial direction of said tubular portion within the interior space of said tubular portion. Said center conductor is secured in place by the above-mentioned outer conductor, with a dielectric interposed therebetween. The above-mentioned center conductor has a radial portion, which has a plate-like configuration extending radially outward from the base portion side of the contact portion, and a connecting portion, which is in contact with a circuit board, formed on the bottom face of said radial portion.

In this coaxial electrical connector according to the present invention, the above-mentioned radial portion has grain flow lines formed by a metallographic structure flow oriented along the two major surfaces opposing each other in the above-mentioned axial direction, and the contact portion has grain flow lines oriented in the above-mentioned axial direction.

According to the thus-configured present invention, in the radial portion, the grain flow lines of the center conductor are oriented in a direction parallel to the two major surfaces opposing each other in the above-mentioned axial direction and, in the contact portion, the lines are oriented in the above-mentioned axial direction, as a result of which the strength of not only the radial portion but also the contact portion is improved.

In the present invention, the center conductor has an annular portion located around the perimeter of the base portion of the contact portion, and said base portion and radial portion can be coupled via said annular portion. Thus, providing the annular portion around the perimeter of the base portion of the contact portion improves the strength of the base portion.

In the present invention, the annular portion preferably has formed therein a curved surface on which the slope of a tangent line lying within a cross-section containing the axis is continuous from the base portion of the contact portion to the radial portion. If such a curved surface is formed in the annular portion, the elimination of surface discontinuities allows for concentrations of stress to be avoided and for the strength of the annular portion to be further improved.

<Manufacturing Method for a Coaxial Electrical Connector>

The present invention is characterized by the fact that, in the above-described manufacturing method for a coaxial electrical connector, a forging tool, which has a pressing surface applying pressure in the through-thickness direction to a major surface substantially perpendicular to said through-thickness direction of the sheet metal and a contact portion-shaping hole recessed from said pressing surface so as to have an axis in a direction substantially perpendicular to said pressing surface, is used to apply pressure to the above-mentioned major surface of the sheet metal using the pressing surface of said forging tool, thereby reducing the thickness of said sheet metal and, at the same time, forcing the material of the reduced-thickness portion of the sheet metal into the above-mentioned contact portion-shaping hole, thereby obtaining a contact portion that extends in the axial direction.

According to the method of this invention, the contact portion is molded by applying pressure to the sheet metal in the through-thickness direction using the forging tool so as to force the material of the reduced-thickness portion into the contact portion-shaping hole of the forging tool, as a result of which the grain flow lines of the contact portion are oriented in the axial direction and it is possible to readily obtain a center conductor having a contact portion of considerable strength.

In the present invention, a transition section of the forging tool between the pressing surface and the contact portion-shaping hole preferably has a tapered surface that extends away from the major surface of the sheet metal toward the contact portion-shaping hole. By doing so, the tapered surface makes it easy to force the material into the contact portion-shaping hole.

[Effects of the Invention]

With respect to coaxial electrical connectors, the present invention allows for the contact portion of the center conductor to have grain flow lines oriented in the axial direction thereof. Therefore, even though coaxial electrical connectors are becoming more compact, their strength can be ensured even at such dimensions. In addition, as concerns the manufacturing method of a coaxial electrical connector, the above-mentioned contact portion is molded by forcing the material of the reduced-thickness portion into the contact portion-shaping hole of the forging tool by applying pressure to the sheet metal in the through-thickness direction thereof with the help of the forging tool and, therefore, simply applying pressure to the sheet metal causes the grain flow lines to run parallel to the axial direction of the contact portion.

BRIEF DESCRIPTION OF THE DRAWINGS

FIG. 2(A) shows a pre-mating state, and FIG. 2(B) shows a mated state.

FIG. 3(A) shows the contact portion prior to molding and FIG. 3(B) shows the contact portion after molding.

FIG. 4(A) shows the contact portion prior to molding, FIG. 4(B) shows the contact portion in the process of molding, FIG. 4(C) shows the contact portion after molding, and FIG. 4(D) shows the periphery of the contact portion after trimming.

DETAILED DESCRIPTION OF THE DRAWINGS

An embodiment of the present invention will be described hereinbelow by referring to the accompanying drawings.

Figure 1:
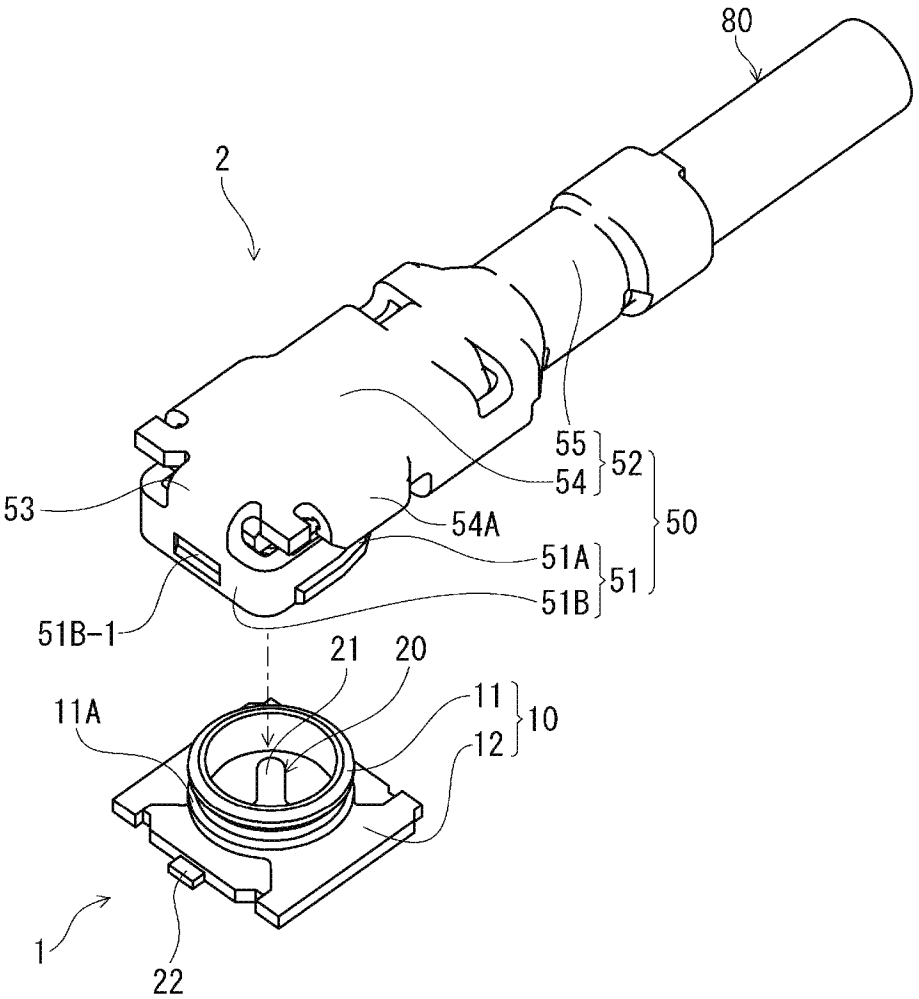
FIG. 1 illustrates a perspective view illustrating a coaxial electrical connector (called "connector" hereinbelow) and a counterpart coaxial electrical connector (called "counterpart connector" hereinbelow) in their pre-mating state in an embodiment of the present invention.
Figure 2A:
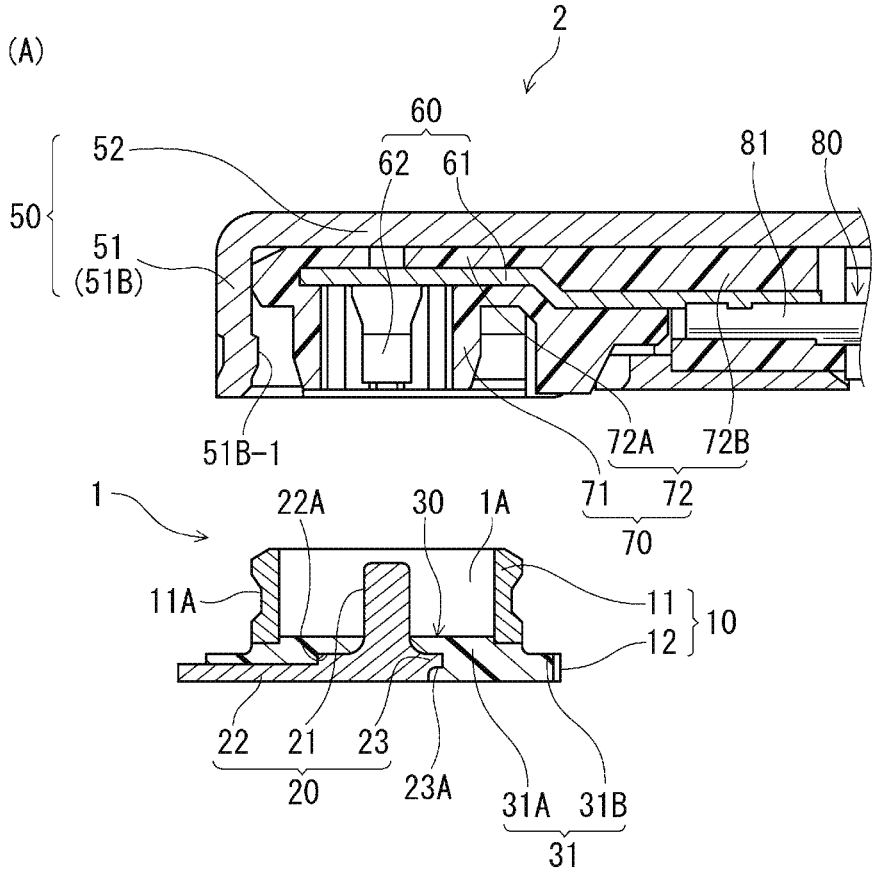
FIGS. 2(A) and 2(B) illustrate a cross-sectional view of the connector and counterpart connector of the present embodiment illustrated in FIG. 1, where
Figure 2B:
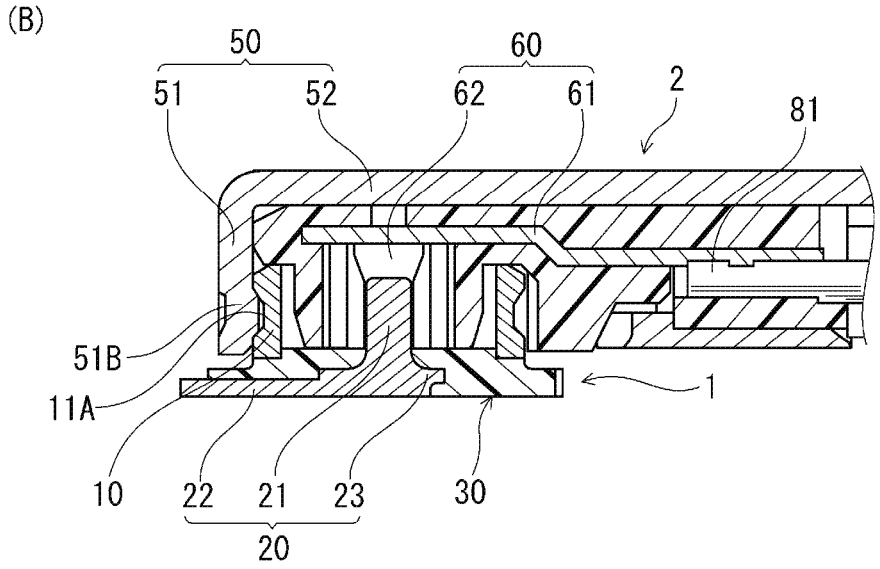

FIG. 1 is a perspective view illustrating a coaxial electrical connector (called "connector" hereinbelow) 1 and a counterpart coaxial electrical connector (called "counterpart connector" hereinbelow) 2, with which the connector 1 is to be mated, in the present embodiment, shown in a state immediately prior to mating. FIGS. 2(A) and 2(B) illustrate a cross-sectional view of the two connectors 1, 2, where FIG. 2(A) illustrates the connectors 1, 2 immediately prior to mating and FIG. 2(B) after mating.

In FIG. 1 and FIG. 2(A), the connector 1 has a metal outer conductor 10, a center conductor 20, and a dielectric 30 that is positioned between the conductors 10, 20 and integrally secures said conductors 10, 20 in place.

The outer conductor 10 has a tubular portion 11 of a cylindrical shape and connecting leg portions 12 projecting radially outward from the lower end of said tubular portion 11 in a flange-like configuration. The above-mentioned tubular portion 11, with its outer peripheral surface mated with the counterpart outer conductor of the counterpart connector 2, forms a contact portion for said counterpart outer conductor, and an annular mating groove 11A of a substantially V-shaped cross-section is formed on the above-mentioned outer peripheral surface in order to prevent extraction during mating with the counterpart outer conductor. The above-mentioned connecting leg portions 12 project from the lower end of the tubular portion 11 at two locations in the circumferential direction of said tubular portion 11 so as to oppose each other in the radial direction. While the connecting leg portions 12 are oriented radially outward, their width in a direction perpendicular thereto is expanded to form a substantially trapezoid planar shape. At least a portion of the lower face of said connecting leg portions 12 is solder-connected to the corresponding circuitry on the circuit board (not shown).

The center conductor 20 has a contact portion 21 in the shape of a shaft with a rounded upper end, which is positioned along the axis of the tubular portion 11 of the above-mentioned outer conductor 10 and extends in the axial direction thereof, and a flat strip-shaped radial portion 22, which is positioned at a single location in the circumferential direction and extends from its base portion constituting the lower end of said contact portion in a radial direction through the hereinafter-described annular portion. The above-mentioned contact portion 21 and radial portion 22 are made by integrally forging stock sheet metal such as copper, brass, phosphor bronze, or other relatively soft materials using the hereinafter-described method, and the grain flow lines, which indicate the flow of metal components, are parallel to the upper and lower major surfaces opposing each other in the above-mentioned axial direction in the radial portion 22 while being parallel to the above-mentioned axial direction in the shaft-like contact portion 21. This point will be discussed again in connection with the manufacturing method of the connector of the present embodiment.

The annular portion 23, which protrudes radially outward from said contact portion 21 and extends in a circumferential direction, is provided at the lower end of the above-mentioned contact portion 21, and the above-mentioned radial portion 22 extends from the above-mentioned contact portion 21 at a single location in the circumferential direction of said annular portion 23. As can be understood from FIG. 2(A), the above-mentioned annular portion 23 has formed therein a curved surface on which the slope of a tangent line lying within a cross-section located in a plane containing the axis of the contact portion 21 (plane parallel to the plane of the drawing) changes in a continuous manner from the above-mentioned contact portion 21 to the radial portion 22. Providing the annular portion 23 with such a curved surface around the base portion of the above-mentioned contact portion 21 improves the strength of the contact portion 21 in said base portion. In this embodiment, the above-mentioned annular portion 23 has a stepped portion 23A formed on the outer peripheral edge of its lower face, with the exception of the area where the radial portion 22 is located, which enhances bonding strength during unitary molding with the hereinafter-described dielectric 30.

The above-mentioned radial portion 22 extends radially outward in a flat strip-like configuration and, as can be seen in FIG. 1 and FIG. 2(A), extends to a position further radially outward than the tubular portion 11 of the outer conductor 10 and the hereinafter-described dielectric 30. This radial portion 22 has a stepped portion 22A formed on its upper face at a location radially between the above-mentioned contact portion 21 and the tubular portion 11 of the outer conductor 10, which also enhances bonding during unitary molding with the hereinafter-described dielectric 30. The lower face of this radial portion 22 is located at the same surface level as the lower faces of the two connecting leg portions 12 of the above-mentioned outer conductor 10 and is solder-connected to the corresponding circuits on the circuit board (not shown), thereby forming a connecting portion therefor.

At a location below the tubular portion 11 of the outer conductor 10, the dielectric 30, which is formed from resin or other dielectric materials, has an internal portion 31A, which is located between said tubular portion 11 and the contact portion 21 of the center conductor 20, and an external portion 31B, which projects in the radial direction beyond the above-mentioned tubular portion 11 between the two connecting leg portions 12 of the outer conductor 10 in the circumferential direction, thereby forming the bottom wall 31 of the connector 1. The space surrounded by the tubular portion 11 above said bottom wall 31 forms a receiving portion 1A used to receive the counterpart connector 2. The lower face of the above-mentioned bottom wall 31 is located at the same surface level as, or slightly above, the lower faces of the two connecting leg portions 12 of the above-described outer conductor 10 and the lower face of the radial portion 22 of the center conductor 20, and the above-mentioned connecting leg portions 12 and radial portion 22 protrude slightly lower than the surface of the bottom wall 31, thereby facilitating solder connection to the circuit board. As can be seen in FIG. 1, in conjunction with the two connecting leg portions 12, the external portion 31B of the above-mentioned bottom wall 31 makes the planar configuration outline of the connector, as viewed from above, substantially square. In addition, at such time, as can be seen in FIG. 1, the distal end of the above-mentioned radial portion 22 protrudes radially outward from the outer edge of the external portion 31B of the bottom wall 31 of the above-mentioned dielectric 30.

The manufacturing method for the center conductor 20 of the above-described connector 1 will be described next.

Figures 3A, 3B:
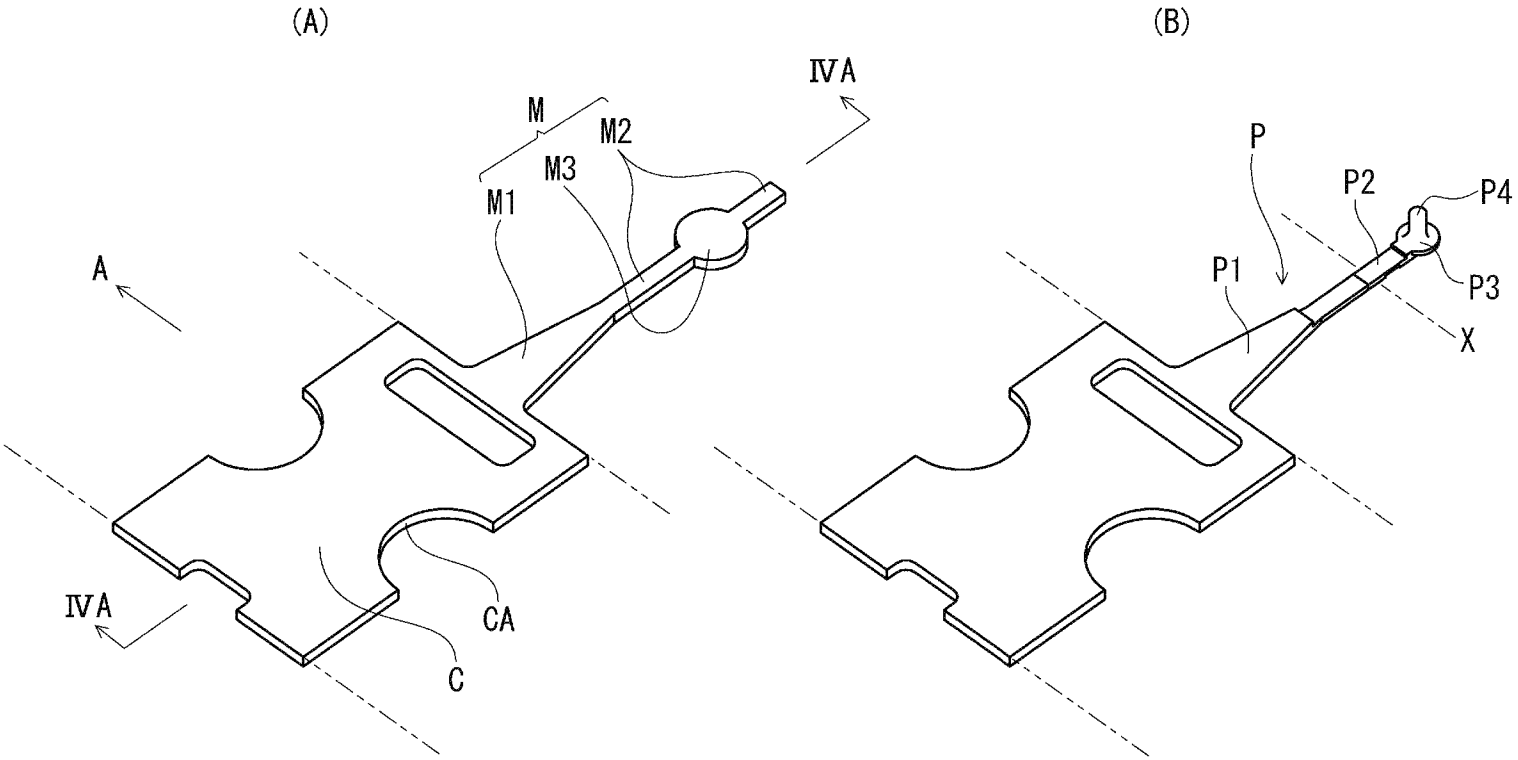
FIGS. 3(A) and 3(B) illustrate a perspective view of an intermediate workpiece illustrating part of the manufacturing process of the connector of FIG. 1, where

First, metal strip-shaped stock is punched to form multiple planar shaping stock pieces M arranged at a constant pitch and supported by carriers C such as the one shown in FIG. 3(A). Feed holes CA are formed in said carriers C to feed said carriers C at the arranged pitch of the above-mentioned multiple shaping stock pieces M in the direction of arrow A during each processing operation.

The shaping stock pieces M shown in FIG. 3(A), which are contoured by stamping, extend from one side edge of the carriers C and have a trapezoidal coupling portion M1 connected to said side edge, a rectilinear portion M2 extending from said coupling portion M1 in a thin flat strip-like configuration, and a disk portion M3 formed at an intermediate location in the longitudinal direction of said rectilinear portion M2.

As a result of intermittently feeding the carriers C, these shaping stock pieces M are sequentially brought to locations where a primary forging process and then a secondary forging process are performed. The way each processing step is carried out at such time is illustrated in FIG. 4.

Figure 4A:
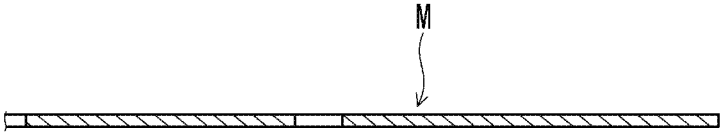
FIGS. 4(A) to 4(D) illustrate a cross-sectional view sequentially illustrating the steps involved in the manufacture of the intermediate workpiece of FIGS. 3(A) and 3(B), where

FIG. 4(A) is a cross-section of such a shaping stock piece M taken in a plane extending in the through-thickness and longitudinal directions thereof.

Figure 4B:
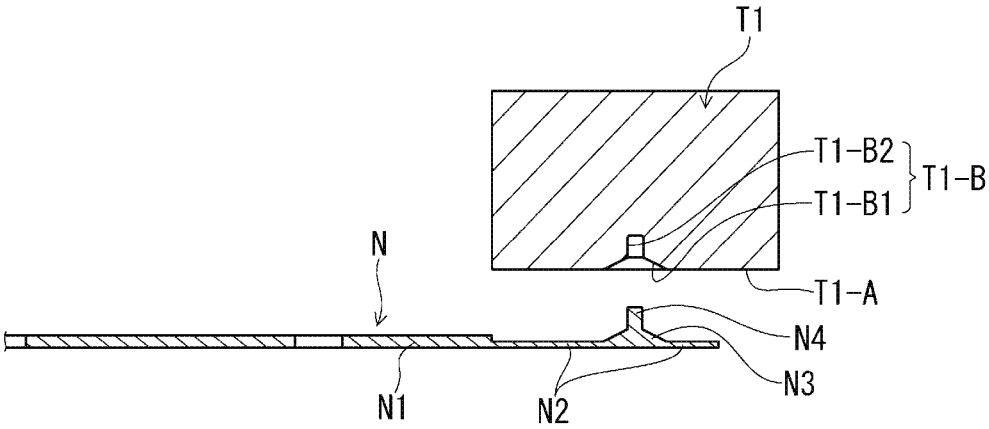

In the primary forging process, as shown in FIG. 4(B), this shaping stock piece M is subjected to vertical press-forming using a primary forging tool T1 and a pedestal (not shown), with said shaping stock piece M processed in the through-thickness direction. As can be seen in FIG. 4(B), the primary forging tool T1 has a primary pressing surface T1-A, which has a block-like configuration and a flat bottom face, and a primary shaping hole T1-B, which is recessed in a substantially perpendicular direction intersecting with said primary pressing surface T1-A. Said primary shaping hole T1-B has a taper-shaping surface T1-B1 that gently slopes away from the above-mentioned primary pressing surface T1-A and a contact portion-shaping hole T1-B2 that extends in a rectilinear manner from a central location on said taper shaping surface T1-B1. When the shaping stock piece M is cold-worked using this primary forging tool T1 by applying pressure to the upper face of said shaping stock piece M from above, the thickness of the section exposed to pressure by the above-mentioned primary pressing surface T1-A is reduced, and the material corresponding to the reduction in thickness is forced into the above-mentioned taper-shaping surface T1-B1 and contact portion-shaping hole T1-B2, thereby obtaining a primary workpiece N with a cross-sectional shape such as the one illustrated in FIG. 4(B). In addition to the coupling portion N1, which is not subjected to any processing using the primary forging tool T1 and is left as is, this primary workpiece N has a strip portion N2, where the rectilinear portion M2 of the shaping stock piece M is reduced in thickness and made thinner, a tapered portion N3, which is molded at an intermediate location of said strip portion N2, and a shaft portion N4, which protrudes upwardly from a central location of said tapered portion N3.

This primary workpiece N is subsequently subjected to the secondary forging process. Although the secondary forging tool T2 has a block-like configuration identical to that of the primary forging tool T1, the radial area that corresponds to the taper-shaping surface T1-B1 of the above-mentioned primary forging tool T1 constitutes a flat molding surface T2-B1 provided as a flat round recessed portion shallowly recessed so as to form a surface parallel to the flat pressing surface T2-A. The dimensions of the contact portion-shaping hole T2-B2, such as its inner diameter and depth from the flat pressing surface T2-A, are not different from those of the contact portion-shaping hole T1-B2 of the forging tool T1 used for primary processing.

Figure 4C:
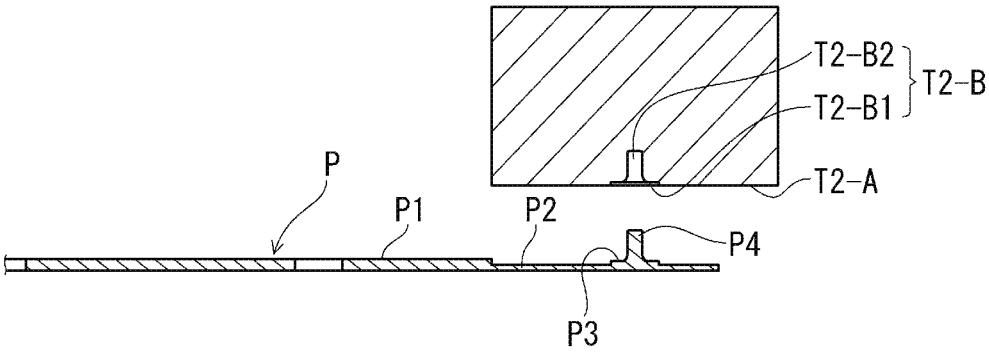

During secondary processing, the pressing surface T2-A of the secondary forging tool T2 is only placed in surface contact with, or applies a light contact pressure to, the strip portion N2 of the primary workpiece N without performing any processing aimed at reducing the thickness of said strip portion N2, and only the above-mentioned flat molding surface T2-B1 applies pressure to the tapered portion N3 of the primary workpiece N, thereby obtaining a secondary workpiece P with a cross-section such as the one illustrated in FIG. 4(C), which has a flat surface where the thickness of said tapered portion N3 is made equal to the average thickness of said tapered portion N3. The thickness of the above-mentioned tapered portion N3 changes such that its thickness is reduced at the center and its thickness is increased around its perimeter, thereby moving the material from the center to the perimeter, as a result of which the tapered portion N3 is shaped to have a flat surface whose thickness is equal to the average thickness of said tapered portion N3 prior to secondary processing, thereby forming an annular protruding portion P3 that serves as the hereinafter-described annular portion. Thus, the secondary workpiece P has a coupling portion P1 that does not differ from coupling portion N1 of the above-mentioned primary workpiece N, a strip portion P2 whose thickness does not differ from the strip portion N2 of the primary workpiece N, a flat annular protruding portion P3 which is obtained by subjecting the above-mentioned tapered portion N3 to pressure forming, and a molded shaft portion P4 which is formed to have a cylindrical outer periphery. As described above, as the processing of the above-mentioned tapered portion N3 progresses, said molded shaft portion P4 forms the base portion of the molded shaft portion P4, which has a cylindrical outer peripheral surface formed as a result of the movement of the material at the center of said tapered portion.

Figure 4D:
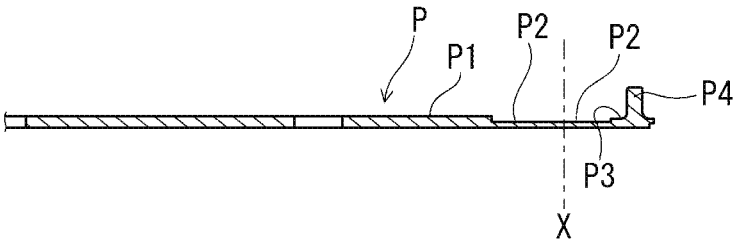

As shown in FIG. 4(D), the perimeter is then cut off such that the annular protruding portion P3 protruding from the base portion of the molded shaft portion P4 in a radial direction is used as the annular portion 23 of the center conductor in its final form, and, if necessary, such that the strip portion P2 corresponds to the width and length of radial portion of the above-mentioned center conductor, thereby obtaining the external configuration of the center conductor (see also FIG. 3(B)). In this state, the above-mentioned strip portion P2 is still coupled to the carrier C through the coupling portion P1, which is subjected neither to primary processing nor to secondary processing.

The thus-formed secondary workpiece P, which is coupled to the carrier through the coupling portion P1, is placed in a position used for unitary molding in a mold for resin molding (not shown) along with the already-shaped outer conductor 10, and, upon injection of molten resin serving as the material of the dielectric 30 into the mold and its solidification, the above-mentioned strip portion P2 is cut at location X in FIG. 4(D), thereby obtaining connector 1 (see FIG. 1 and FIG. 2(A)) provided with a center conductor 20 having a radial portion 22 protruding by a predetermined length from the center conductor 20 and dielectric 30.

Figure 5:
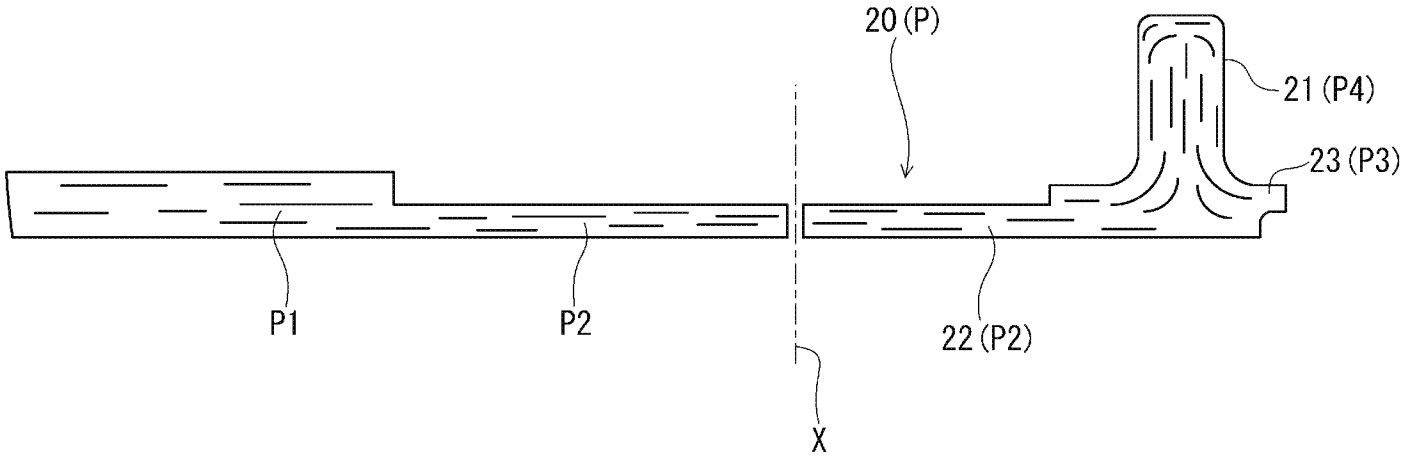
FIG. 5 illustrates a diagram illustrating grain flow lines in the intermediate member of FIG. 4(D).

In the thus-fabricated center conductor 20, the grain flow lines, which represent the flow of metallographic structure in a cross section lying in a plane containing the axis of the contact portion 21 (cross section taken in the through-thickness direction of the radial portion 22), are as shown in FIG. 5 as a result of undergoing the forging shown in FIG. 4(B) and FIG. 4(C). Since the sheet metal used as the original source material is fabricated by rolling, as can be seen in FIG. 5, in the radial portion 22, the grain flow lines are parallel to the upper and lower major surfaces opposing each other in the above-mentioned axial direction, and, in addition, in the contact portion 21 molded using the inventive forging process, the lines are oriented in the axial direction, as a result of which the strength of the contact portion 21, as well as that of the radial portion 22, is improved. Here, the meaning of "parallel to the above-mentioned two major surfaces" includes "substantially parallel" and may include not only parallel-direction components, but also components in other directions, including cases of grain flow lines indicating flows, in which the parallel-direction components are larger than the components in other directions. In this manner, the grain flow lines in the radial portion 22 and contact portion 21 represent different intersecting directions, oriented along the surface of the respective sections of material. In addition, the phrase "the grain flow lines are parallel to both major surfaces" means that while they are oriented in the longitudinal direction of the radial portion in a plane parallel to said major surfaces, they may be oriented in a width direction perpendicular thereto. In addition, the upper and lower major surfaces of the radial portion do not have to be parallel and may be oriented at an inclination (i.e., with a taper, etc.), and may have a number of stepped sections.

The counterpart connector 2, which is mated with the connector 1 configured and manufactured as described above, will be explained next with reference to FIG. 1 and FIG. 2(A).

The counterpart connector 2 is mated with the connector 1 in the direction of the common axis of the contact portion 21 of the center conductor 20 and the tubular portion 11 of the outer conductor 10 of the connector 1, and a cable is connected thereto so as to extend in a direction substantially perpendicular to this axis. Since the present invention has features relating to the previously-described connector 1, particularly to the center conductor 20, and does not focus on the counterpart connector 2, the counterpart connector 2 will be described in a simplified manner.

The counterpart connector 2 has an outer conductor 50, a center conductor 60, and a dielectric 70. The center conductor 60 has a strip-shaped wire connecting portion 61, which extends in the longitudinal direction of a cable 80, and a contact portion 62, which is provided so as to extend downward from one end portion of said wire connecting portion 61. In this embodiment, said contact portion 62 is formed as a pair of contactors arranged with a gap therebetween in a direction perpendicular to the plane of the drawing in FIGS. 2(A) and 2(B). Each contactor is shaped as a thin strip, whose surface is parallel to the plane of the drawing and which is resiliently deformable in a direction perpendicular to the plane of the drawing. Said pair of contact portions 62 is mated with the contact portion 21 of the center conductor 20 of the previously-described connector 1 from above by clamping said contact portion 21 with resilient pressure.

The core wire 81 of the cable 80 is connected to the other end portion of the wire connecting portion 61 of the above-mentioned center conductor 60 by caulking or soldering.

The above-mentioned center conductor 60 is secured in place by the dielectric 70. The dielectric 70 has a cylindrical portion 71, which surrounds the above-mentioned contact portion 62, and a retaining portion 72, which integrally secures in place the wire connecting portion 61 of the above-mentioned center conductor 60. The retaining portion 72 has a cover portion 72A, which covers the top portion of the above-mentioned cylindrical portion 71, and an arm portion 72B, which extends in a radial direction from said cover portion 72A outside of the above-mentioned cylindrical portion 71. Said arm portion 72B surrounds the wire connecting portion 61 of the above-mentioned center conductor 60 in a radial direction outside of the above-mentioned cylindrical portion 71.

The outer conductor 50 has a mating portion 51, which surrounds the tubular portion 11 of the outer conductor 10 of the connector 1, except in the range in which the above-mentioned wire connecting portion 61 and the arm portion of the dielectric 70 that surrounds it in a circumferential direction are present, and fits over said tubular portion 11 from above, and a retaining portion 52, which secures the above-mentioned dielectric 70 in place.

While having a substantially square tube-like configuration in FIG. 1, the above-mentioned mating portion 51 has a section 51A with an arcuate cross-section designed to hold the above-mentioned tubular portion 11 in a circumferential direction while being mated with the connector 1 at a location proximate to the cable, and, when mated with the above-mentioned tubular portion 11 from above, this section, along with the section 51B on the side opposite the cable, comes in contact with the above-mentioned tubular portion 11 at multiple positions in the circumferential direction relative to said tubular portion 11. In the above-mentioned section 51B on the side opposite the cable, an engagement protrusion 51B-1, which is formed on the interior surface side by embossing from the exterior surface side of said section 51B, engages with the annular mating groove 11A of the above-mentioned tubular portion 11 to prevent the connector from being extracted.

As can be seen in FIG. 1, the retaining portion 52 has an upper plate portion 54 which, as a result of being coupled to the above-mentioned section 51B on the side opposite the cable of the above-mentioned mating portion 51 via a waisted portion 53 and subsequently bent, is positioned on the upper face of said cover portion 72A so as to cover the cover portion 72A of above-mentioned dielectric 70, and a retaining tubular portion 55, which extends from said upper plate portion 54 and covers the arm portion 72B of the dielectric 70 in the circumferential direction of said arm portion 72B.

As can be seen in FIG. 1, while the above-mentioned upper plate portion 54 has mostly a flat plate-like configuration, it has laterally protruding and downwardly bent protrusions 54A provided to assist the operation of removal of the counterpart connector 2 from the connector 1.

As can be understood from FIG. 1, the retaining tubular portion 55 has a tubular configuration designed to surround the wire connecting portion 61 of the center conductor 60, to which the core wire 81 of the cable is connected, and the retaining portion 72 of the dielectric 70 that secures it in place, thereby integrally fastening the above-mentioned wire connecting portion 61 to the retaining portion 72 and securing them in place.

The thus-shaped counterpart connector 2 is mated with the previously described connector 1 in the following manner.

First, the connector 1 is attached to a corresponding circuit board (not shown). The connector 1 is placed in a predetermined position on said circuit board and the connecting leg portions 12 of the outer conductor 10, as well as the radial portion 22 of the center conductor 20, are solder-connected to the corresponding circuits.

Next, as can be seen in FIG. 2(A), the counterpart connector 2, to which the cable 80 is connected, is positioned such that the pair of contact portions 62 are located above the contact portion 21 of the center conductor 20 of the above-mentioned connector 1, and the counterpart connector 2 is lowered.

With its pair of contact portions 62 resiliently clamping the contact portion 21 of the center conductor 20 of the connector 1, the center conductor 60 of the above-mentioned counterpart connector 2 travels downwardly to a final mating position. Meanwhile, the outer conductor 50 of the counterpart connector 2, with its mating portion 51 fitted over the tubular portion 11 of the connector 1, travels downwardly and, in the final mating position, the engagement protrusion 51B-1 of the mating portion 51 engages with the annular mating groove 11A of the above-mentioned tubular portion 11 to prevent the extraction of the connectors 1, 2.

DESCRIPTION OF THE REFERENCE NUMERALS

1 (Coaxial electrical) connector
10 Outer conductor
11 Tubular portion

20 Center conductor
21 Contact portion
22 Radial portion
23 Annular portion
30 Dielectric
T Forging tool
T1-A (Primary) pressing surface
T1-B1 Taper (shaping) surface
T1-B2 Contact portion-shaping hole

The invention claimed is:

1. A coaxial electrical connector connected to a circuit board, comprising:

a metal outer conductor having a tubular portion, and a metal center conductor comprising:

a contact portion extending in an axial direction of said tubular portion within an interior space of said tubular portion, and in which said center conductor is secured in place by the outer conductor, with a dielectric interposed therebetween, a radial portion with a plate-shaped configuration extending radially outward from a base portion side of the contact portion, and a connecting leg portion placed in contact with a circuit board formed on a bottom face of said radial portion, wherein the contact portion is a solid contact comprising an annular portion provided around a perimeter of a base portion of the contact portion;

wherein the radial portion extends radially outward in a radial direction from the annular portion along a same plane as the annular portion;

wherein the connecting leg portion comprises a strip portion extending from the annular portion in a circumferential direction;

wherein the contact portion is formed from a sheet metal and forged such that the contact portion has a height greater than a thickness of the sheet metal, and such that the contact portion is made solid from the sheet metal.

2. The coaxial electrical connector according to claim 1, wherein the radial portion has a thickness that is thinner than that of a thickness of the annular portion.

3. A manufacturing method for the coaxial electrical connector of claim 1, wherein a forging tool, comprising a pressing surface applying pressure in the through-thickness direction to a major surface substantially perpendicular to the through-thickness direction of the sheet metal, and a contact portion-shaping hole recessed from said pressing surface so as to have an axis in a direction substantially perpendicular to said pressing surface, is used to apply pressure to the major surface of the sheet metal using the pressing surface of said forging tool, thereby reducing the thickness of said sheet metal and, at the same time, forcing the material of the reduced-thickness portion of the sheet metal into the contact portion-shaping hole to obtain the contact portion that extends in the axial direction;

wherein a transition section of the forging tool between the pressing surface and the contact portion-shaping hole has a tapered surface that extends away from the major surface of the sheet metal toward the contact portion-shaping hole.

4. The manufacturing method for a coaxial electrical connector according to claim 3, wherein for a primary forging process of the manufacturing method, the tapered surface is formed around the periphery of the shaft portion forming the contact portion, and during a secondary forging process of the manufacturing method, a flat annular protruding portion is formed around the circumference of the molded shaft portion to form the annular portion.

5. The coaxial electrical connector according to claim 1, further comprising a circular flat surface formed in the base portion side of the contact portion in an axial direction.

* * * * *